US007320180B2

(12) United States Patent
Phillips et al.

(10) Patent No.: US 7,320,180 B2
(45) Date of Patent: Jan. 22, 2008

(54) NAIL CLIPPER HAVING NESTING INTEGRAL FINGER LOOPS

(76) Inventors: Gordon Lane Phillips, 508 - 7th Street SE, High River, Alberta (CA) T1V 1K8; Peter Wayne Dixon, Unit 269 - 8948 Elbow Drive SW, Calgary, Alberta (CA) T2V 0H9

( * ) Notice: Subject to any disclaimer, the term of this patent is extended or adjusted under 35 U.S.C. 154(b) by 0 days.

(21) Appl. No.: 10/141,185

(22) Filed: May 9, 2002

(65) Prior Publication Data

US 2003/0208906 A1 Nov. 13, 2003

(51) Int. Cl.
*A45D 29/02* (2006.01)

(52) U.S. Cl. ..... 30/28; 30/145; 30/175; 132/73.5

(58) Field of Classification Search ..... 30/28, 30/26, 145, 175; 132/73, 73.5; D28/56, D28/60

See application file for complete search history.

(56) References Cited

U.S. PATENT DOCUMENTS

| | | | | | |
|---|---|---|---|---|---|
| 970,067 | A | | 9/1910 | Leineweber | |
| 3,997,966 | A | * | 12/1976 | Sartore | 30/28 |
| D286,091 | S | * | 10/1986 | Hill | D28/60 |
| 5,384,960 | A | | 1/1995 | Tottenham | |
| 5,570,509 | A | * | 11/1996 | Killian | 30/28 |
| D397,516 | S | * | 8/1998 | Ishida | D28/60 |
| 6,220,251 | B1 | * | 4/2001 | Jeong et al. | 30/28 X |
| D459,549 | S | * | 6/2002 | Savoie | D28/60 |
| D482,823 | S | * | 11/2003 | Toney | D28/60 |

* cited by examiner

*Primary Examiner*—Timothy V. Eley

(57) ABSTRACT

A rigid first loop is rigidly mounted to the first end of at least one of a pair of nail clipper mandibles. A rigid second loop is rigidly mounted to the distal end of the nail clipper operating lever. The first and second loops lie in substantially parallel, adjacent planes, when the operating lever is in either its deployed position or its storage position. The loops are nested side-by-side when the operating lever is folded-down into the storage position.

9 Claims, 2 Drawing Sheets

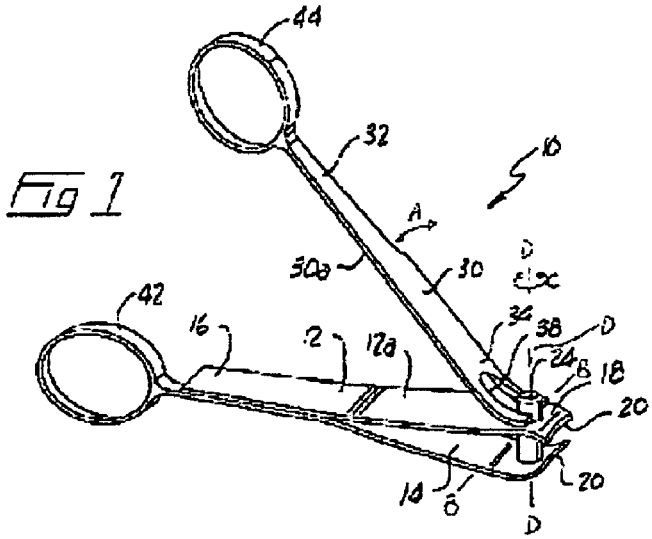
Fig 1
44
32
10
A
30a
30
D
42
16
12
12a
34
38
D
24
B
18
20
14
C
20
D
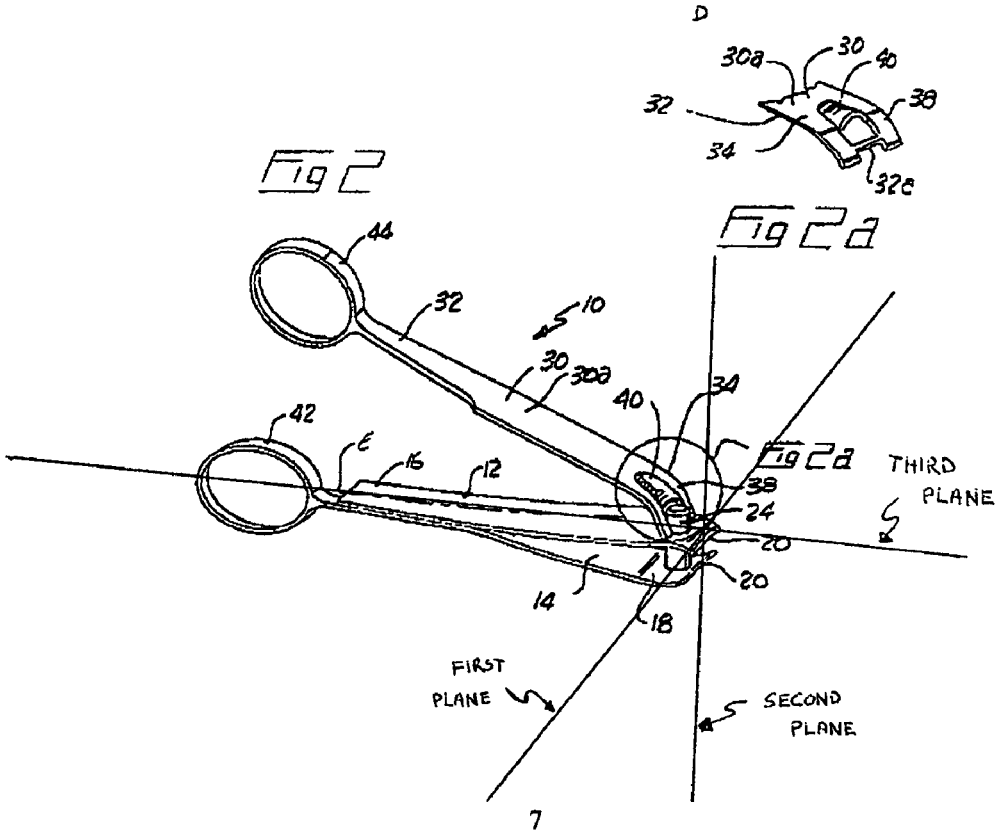
D
30a
30
40
32
38
34
32c
Fig 2
Fig 2a
44
32
10
30
30a
40
34
42
E
16
12
Fig 2a
THIRD PLANE
38
24
20
20
14
18
FIRST PLANE
SECOND PLANE

NAIL CLIPPER HAVING NESTING INTEGRAL FINGER LOOPS

FIELD OF THE INVENTION

This invention relates to a nail clipper having an integral finger loop formed with both the closable mandible and the rotatable operating lever, through which the thumb and forefinger may be inserted, to enhance the users ability to open, grip, accurately position and exert force to the implement to perform a manicure.

BACKGROUND OF THE INVENTION

Most common nail clippers comprise upper and lower mandibles, which are connected together at one end and at their opposite ends the mandibles have opposed facing jaws having sharpened cutting edges. The mandibles are generally manufactured from spring steel or the like and are slightly divergent from each other from their point of connection, at one end, to the cutting edges at the other. The mandibles are apertured near the cutting edges to accept a rotatable hinge post, which is disposed generally at right angles to the cutting edges.

An operating lever is secured to the hinge post and has an upstanding cam surface formed thereon, adjacent to the hinge post. The operating lever may be elevated and rotated from a position nested adjacent the upper mandible to an inverted position in vertical alignment above the upper mandible with the cam surface rotated so as to be brought in engagement with exposed face of the upper mandible. Through pressure on the operating lever, the cam surface on the operating lever forces the upper mandible into contact with the lower mandible to thereby clip a nail positioned therebetween.

A shortcoming of this design is the difficulty of securely gripping the nail clipper so as to firmly and accurately position the clipper adjacent a nail so as to position and maintain the nail between the jaws without shearing while applying sufficient pressure on the operating lever to close the jaws to cut the nail. Where there is a sufficient size difference between the clipper and the operators hand, or where the hand of the operator suffers an injury or illness which limits the force or accuracy which the force may be applied to the operating lever, or where the operator's hands are slippery from water, soap or toiletry products, operation of the clipper may be difficult.

To overcome this difficulty, the nail clipper of the present invention has a first finger loop solidly mounted to or formed as part of the lower mandible. A second finger loop is similarly mounted to or formed as part of the operating lever. This permits the clipper to be conveniently and accurately positioned and maintained adjacent to a nail to perform a manicure operation with the clipper. The use of finger loops on nail clippers are however known in the prior art. Examples are illustrated in U.S. Pat. No. 3,997,966 to Sartore and in U.S. Pat. No. 5,384,960 to Tottenham. However, in the nail clipper of Sartore, when the nail clipper is folded to its non-clipping aspect the looped handles are brought into alignment and project outwardly from the lower mandible and operating lever respectively, making storage awkward. In the device of Tottenham, the finger loops are ring members rotatably mounted to the mandibles, at their commonly mounted ends, and to the operating lever. The rings fold over for storage, and are free to also unstably fold over during use, thus making them more difficult to use.

What is not taught or suggested, and which is one object of the present invention to provide, is a nail clipper having first and second finger loops rigidly mounted to the mandibles and the rotatable operating lever respectively, so as to permit the nail clipper to be conveniently and accurately positioned and maintained adjacent to a nail to be cut, with the clipper positioned either outwardly of the hand, that is in alignment with the extended fingers, or inwardly of the hand, that is generally toward the palm of the hand, where the first finger loop nests snugly adjacent to and in parallel alignment with the second finger loop when the operating lever is in its storage or closed position.

SUMMARY OF THE INVENTION

In summary, the nail clippers of the present invention include first and second resilient mandibles, and an operating lever mounted to a hinge post mounted to the mandibles. The first and second mandibles are mounted together at first ends thereof. The first and second mandibles diverge from their first ends to their opposite second ends. The second ends of the mandibles are formed as jaws having opposed facing cutting edges.

The hinge post is rotatably journalled through co-axial apertures through the second ends of the mandibles and is rotatably mounted to the second mandible. An end of the hinge post protrudes from the first mandible. The operating lever is pivotally mounted to the protruding end of the hinge post for rotation of the operating lever, when oriented into a deployed position, so as to bias a cam surface on a first side of the operating lever against the first mandible to thereby urge the jaws closed. The jaws may be closed so as to pinch the cutting edges together by compression of the second ends of the mandibles together by the rotation of the operating lever when in the deployed orientation. The operating lever may be inverted relative to the mandibles so as to fold down into a storage position adjacent the mandibles.

A rigid first loop handle or merely "loop" is rigidly mounted to the first end of at least one of the mandibles. A rigid second loop is rigidly mounted to the distal end of the operating lever. The first and second loops lie in substantially parallel, adjacent planes, when the operating lever is in either the deployed position or the storage position. The loops are nested side-by-side when the operating lever is folded-down into the storage position.

In one embodiment the cutting edges lie generally in a first plane, and the operating lever rotates for compression of the mandibles, and the mandibles are compressed in, a second plane which is perpendicular to the first plane. The substantially parallel adjacent planes in which the loops lie are parallel to the second plane.

The first loop may be mounted to the first end of the second mandible. The operating lever may be asymmetric relative to the second plane when in the storage position so as to nest the first loop on one side of the second plane and the second loop adjacently on the opposite side of the second plane. For example, the distal end of the operating lever may be asymmetrically tapered so as to thin from the end mounted to the hinge post to the first loop.

The operating lever may be an elongate substantially planar member which, when in the storage position, is lying in a third plane generally orthogonal to both the first and second planes and substantially parallel to the first mandible.

The loops may be substantially identically shaped so as to rest flush alongside one another when the operating lever is in the storage position. The loops may be arcuate, for example circular rings.

BRIEF DESCRIPTION OF THE DRAWINGS

FIG. 1, is an isometric view of the nail clippers with the operating lever rotated about the hinge post to its operating position for clipping.

FIG. 2 is an isometric view of the nail clippers with the operating lever rotated for folding down into its storage position.

FIG. 2*a* is an enlarged isometric view of the operating lever yoke of FIG. 2.

DETAILED DESCRIPTION OF EMBODIMENTS OF THE INVENTION

Figure 3:
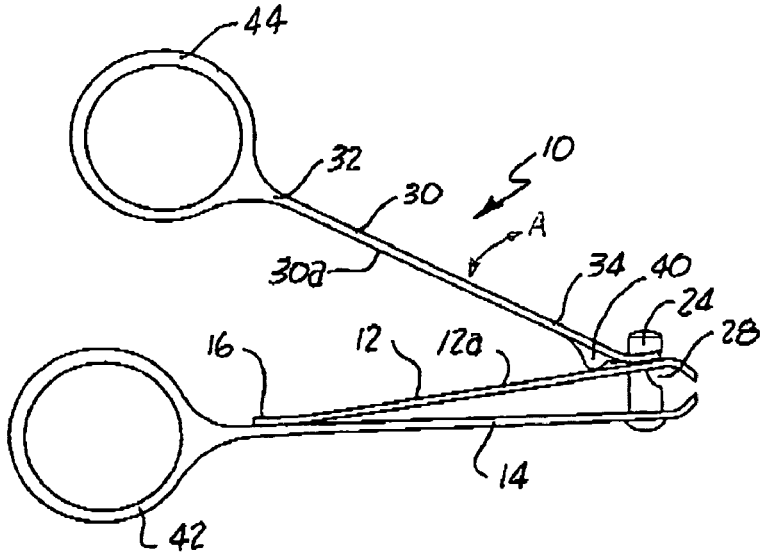
FIG. 3 is a side elevation of the clippers in the clipping position.

The present invention is a nail clipper comprising diverging resilient upper and lower mandibles. An operating lever having opposite first and second surfaces is rotatably mounted at a second end to a hinge post. The hinge post is itself rotatably mounted through corresponding apertures in the diverged second ends of the mandibles, opposite their first ends. The hinge post is generally at right angles to the mandibles. Alternatively, rather than the mandibles being separate upper and lower members connected together at their common first end, the mandibles may be a single 'U' shaped member. The second ends of the mandibles are formed as jaws having opposed facing cutting edges lying generally in a first plane which is orthogonal to the mandibles.

The operating lever may have a yolk formed at the first end. The yoke has a pair of arms which are disposed on either side of the stub-end of the hinge post protruding from the upper mandible. The arms are pinned to the stub-end of the hinge post for rotation of the yoke over the stub-end. The operating lever is thus rotatable over the stub-end of the hinge post, and the hinge post rotatable relative to the mandibles, so as to be pivotable from a storage position where the operating lever lies nested adjacent the upper mandible, to an inverted operable position in vertical alignment above the upper mandible. An upstanding cam surface is formed on the first surface of the operating lever adjacent the hinge post. When the operating lever is in its inverted operable position, the cam surface is brought into engagement with the upper surface of the upper mandible adjacent the hinge post. The operating lever is operated by its rotation in a second plane about the pinned mounting of the yoke to the hinge post so as to engage the cam downwardly onto the upper mandible to thereby close the jaws. The first and second planes are orthogonal. A first rigid loop is formed at the first end of the operating lever opposite its second end, the loop lying in-the second plane when the operating lever is in either its operating position or its storage position. A second rigid loop is formed at the common first end of the mandibles so as to lie in a third plane parallel and adjacent the second plane. The first and second loops thus may be nested side-by-side when the operating lever is folded down into its storage position.

With reference to the drawing figures, wherein similar characters of reference denote corresponding parts in each view, nail clipper 10 has upper and lower mandibles 12 and 14 respectively. The mandibles are mounted to each other at their respective first ends 16 and have at second ends 18 opposed facing sharpened cutting edges 20 forming a jaw. Both mandibles may be resilient, for example made from spring steel or the like and slightly diverge from each other from first ends 16, towards second ends 18 so that, at repose, cutting edges 20 are parallel and slightly spaced apart so as to accept a nail for clipping therebetween.

A rotatable hinge post 24 disposed generally at right angles to cutting edges 20 and to the mandibles is fitted through apertures formed in upper and lower mandibles 12 and 14 in proximity to second ends 18. A stub-end of hinge post 24 extends outwardly from upper mandible 12. Post 24 has a recess 28 formed therein.

An operating lever 30, having first and second ends 32 and 34 respectively is pivotally mounted to post 24 by means of yoke 38 formed at second end 34. Pin or cross bar 32*a* of yoke 38 engages a portion of recess 28 projecting above face 12*a* of upper mandible 12 and is retained therein through the upward spring tension of mandible 12 against operating lever 30. A projecting cam surface 40 is formed on face 30*a* of operating lever 30 adjacent hinge post 24.

Figure 4:
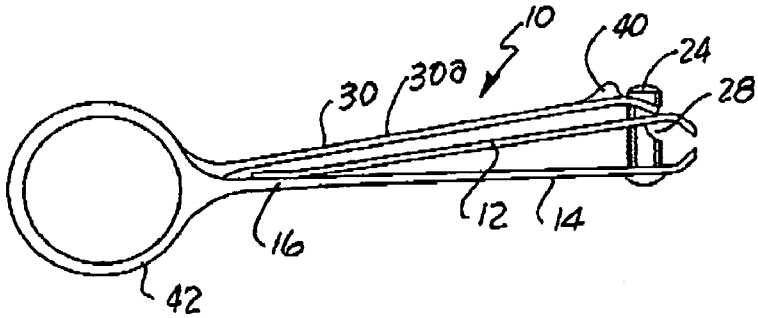
FIG. 4 is a side elevation of the clippers folded down into the storage position.

Lever 30 in its closed aspect, as viewed in FIG. 4, lies closely generally parallel to upper mandible 12. In the operating aspect second end 34 of lever 30 is elevated and is vertically pivotable on and over hinge post 24 in direction A about axis B by means of yolk 40. When lever 30 is raised sufficiently in direction A, it may be rotated in direction C about axis D together with hinge post 24 to align it, once inverted, again with upper mandible 12. Face 30*a* of operating lever 30, as illustrated in FIGS. 1 and 3, is now positioned adjacent to upper mandible 12 with cam surface 40 in contact with mandible 12.

Rigid finger and thumb loops 42 and 44, respectively, are formed on or mounted to (collectively referred to herein as being formed on) both first end 16 of lower mandible 14 and first end 32 of operating lever 30. Loop 42 is oriented so as to lie entirely on a first side of centerline E of clipper 10, the centerline lying in the second plane. Loop 44 is positioned and oriented so as to lie on the opposite second side of centerline E. This may be accomplished by tapering lever 30 slightly near its first end 32.

Figure 5:
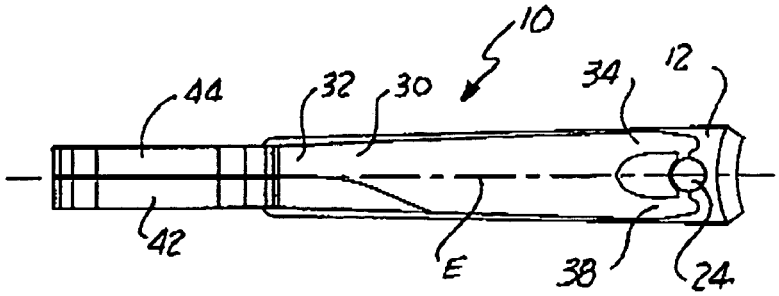
FIG. 5 is a plan view of the clippers in the closed position.

When lever 30 is folded down into its closed, non-operational storage position, as seen in FIGS. 4 and 5, loops 42 and 44 nest snugly adjacent to, in parallel alignment with each other, thus providing for improved compact storage of the clippers without sacrificing the stability and ease of use gained by the use of the rigid finger and thumb loops.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Nail clipper having nesting integral finger loops comprising first and second resilient mandibles, an operating lever mounted to a hinge post mounted to said mandibles, said first and second mandibles mounted together at first ends thereof, said first and second mandibles diverging from said first ends to opposite second ends, said second ends of said mandibles formed as jaws having opposed facing cutting edges, said hinge post rotatably journalled through co-axial apertures through said second ends of said mandibles and is rotatably mounted to said second mandible so as to protrude an end of said hinge post from said first mandible, said operating lever pivotally mounted to said end of said hinge post for rotation of said operating lever, when oriented into a deployed position, so as to bias a cam surface on a first side of said operating lever against said first mandible to thereby urge said jaws closed, wherein said jaws may be closed so as to pinch said cutting edges together by compression of said second ends of said mandibles together by said rotation of said operating lever when in said deployed orientation, wherein said operating lever may be inverted relative to said mandibles so as to fold down into a storage position adjacent said mandibles, a rigid first loop rigidly mounted to said first end of at least one of said mandibles, a rigid second loop, rigidly mounted to the distal end of said operating lever, said first and second loops lying in substantially parallel, adjacent planes, when said operating lever is in either said deployed position or said storage position, and said loops nested side-by-side when said operating lever is folded-down into said storage position, wherein said cutting edges lie generally in a first plane, and wherein said operating lever rotates for compression of said mandibles,—and said mandibles are compressed in, a second plane which is perpendicular to said first plane,—and wherein said substantially parallel adjacent planes in which said loops lie are parallel to said second plane,— and wherein said first mandible lies in a third plane substantially perpendicular to said first and second planes, and wherein said third plane substantially bisects said loops so as to minimize the extent to which said loops extend in said second plane outwardly from said first and second mandibles whereby the space occupied by said nail clippers is minimized when said operating lever is in said storage position.

2. The nail clipper having nesting integral finger loops of claim 1 wherein said loops are substantially circular.

3. The nail clipper having nesting integral finger loops of claim 1 wherein said first loop is mounted to said first end of said second mandible.

4. The nail clipper having nesting integral finger loops of claim 1 wherein said operating lever is asymmetric relative to said second plane when in said storage position so as to nest said first loop on one side of said second plane and said second loop adjacently on the opposite side of said second plane.

5. The nail clipper having nesting integral finger loops of claim 4 wherein said operating lever is an elongate substantially planar member which, when in said storage position, is lying in said third plane generally orthogonal to both said first and second planes and substantially parallel to said first mandible.

6. The nail clipper having nesting integral finger loops of claim 5 wherein said loops are substantially identically shaped so as to rest flush alongside one another when said operating lever is in said storage position.

7. The nail clipper having nesting integral finger loops of claim 6 wherein said loops are arcuate.

8. The nail clipper having nesting integral finger loops of claim 7 wherein said loops are circular rings.

9. The nail clipper having nesting integral finger loops of claim 8 wherein said distal end of said operating lever is tapered so as to thin from said end mounted to said hinge post to said first loop.

* * * * *